United States Patent [19]

Garay et al.

[11] Patent Number: 4,921,431

[45] Date of Patent: May 1, 1990

[54] CONNECTOR ADAPTER ASSEMBLY

[75] Inventors: Antonio A. Garay, Roselle; Tedford H. Spaulding, Chicago; Robert L. Valleau, Des Plaines, all of Ill.

[73] Assignee: Switchcraft, Inc., Chicago, Ill.

[21] Appl. No.: 300,455

[22] Filed: Jan. 23, 1989

[51] Int. Cl.[5] ..... H01R 9/09

[52] U.S. Cl. ..... 439/79; 439/95; 439/589

[58] Field of Search ..... 439/79, 82, 95, 278, 439/282, 300, 324, 369, 383, 384, 550, 551, 588, 589, 603

[56] References Cited

U.S. PATENT DOCUMENTS

| | | | |
|---|---|---|---|
| 3,335,387 | 8/1967 | Mueller | 439/79 |
| 4,397,511 | 8/1983 | Clark et al. | 439/79 |
| 4,637,669 | 1/1987 | Tajima | 439/95 |
| 4,842,554 | 6/1989 | Cosmos et al. | 439/79 |

*Primary Examiner*—P. Austin Bradley

*Attorney, Agent, or Firm*—William R. Clark; Richard M. Sharkansky

[57] ABSTRACT

A connector adaptor assembly comprising a trough-like frame made of resilient dielectric material and having a connector retainer end portion wherein opposing side walls of the frame are integrally joined to respective taller resilient posts having respective inwardly projected portions extending toward one another. Distal end portions of the posts have adjacent an end of the frame respective surfaces supporting respective integrally protruding bosses which are spaced laterally a predetermined distance apart. The assembly also includes an electrical connector with a cylindrical body disposed recumbently in the frame and having chordally disposed in opposing portions thereof respective slots which are aligned with the respective posts. Adjacent the slots, an annular flange extends radially outward of the body and has a diameter greater than the predetermined distance of lateral spacing between the bosses. The flange has respective peripheral cam portions along which the bosses slide in causing the distal end portions of the resilient posts to bend laterally away from one another and then return laterally toward one another. The peripheral cam portions terminate in respective latching notches wherein the bosses snap resiliently thereby allowing the distal end portions of the posts to return to their relaxed states and inserting their inwardly projecting portions into the respective aligned slots.

6 Claims, 3 Drawing Sheets

CONNECTOR ADAPTER ASSEMBLY

BACKGROUND OF THE INVENTION

1. Field of the Invention

This invention relates generally to electrical connector assemblies and is concerned more particularly with an electrical connector provided with an adaptor for mounting the connector readily on a supporting printed circuit board.

2. Discussion of the Prior Art

In electrical apparatus, dense packaging of electrical circuitry has been achieved by wide spread use of printed circuit boards having a plurality of conductors plated in insulating spaced relationship with one another on a planar dielectric substrate. Electrical components of the circuitry may be mounted on one or both extended flat surfaces of the dielectric substrate and connected directly to the printed circuit conductors by means of holes extended through the thickness of the board. The printed circuit conductors may be routed to respective terminal holes disposed in a predetermined pattern in a marginal portion of the board for electrical connection to respective terminals of an electrical connector mounted on the board. Thus, the connector on the board may be mated with a similarly configured connector on an adjacent end portion of an electrical cable for feeding electrical energy to connecting conductors of the printed circuit board.

However, the printed circuit board may be disposed in an array of substantially parallel and closely spaced printed circuit boards whereby only edge portions of their dielectric substrates are accessible from externally of the array. Consequently, a printed circuit board generally has its board connector mounted on a marginal portion of the dielectric substrate and has the mating end portion of the board connector facing outwardly of the adjacent edge of the board. As a result, the mating contact members in the body of the board connector are disposed substantially parallel to the dielectric substrate of the printed circuit board, and require right-angle terminal means for connection to respective terminal holes in the dielectric substrate. Moreover, if the board connector has a configuration, such as cylindrical, for example, which does not conform readily to the planar dielectric substrate, auxiliary hardware and tools may be required for mounting the board connector as desired, such as tangentially to the dielectric substrate, for example. Thus, the mounting of the board connector on the dielectric substrate of the printed circuit board may require an excessive expenditure of time and labor which significantly increase the cost of producing the resulting printed circuit board assembly.

SUMMARY OF THE INVENTION

Accordingly, these and other disadvantages of the prior art are overcome by this invention providing a cylindrical connector with an adaptor housing by means of snapping the connector into the housing for mounting the connector with its axial centerline substantially parallel to a supporting printed circuit board without the need of auxiliary fastener devices.

The connector comprises a cylindrical body including a metallic shell encircling a dielectric insert having axially disposed therein a plurality of mutually spaced contact members. The contact members have respective contact engaging end portions extended toward a connector mating end portion of the cylindrical body and have respective terminal end portions extended out of an opposing terminal end portion of the cylindrical body. Chordally disposed in the external surface of the metallic shell are two diametrically opposed, retainer slots having respective side walls adjacent the mating end portion of the cylindrical body formed of adjacent surface portions of an annular flange which extends radially outward of the metallic shell. The flange has disposed in portions thereof adjacent each of the retainer slots respective latching notches which are equally spaced from an orientation notch in the flange by respective interposed cam portions of the flange. With the cylindrical body in a recumbent position and the orientation notch constituting the lowermost peripheral portion of the flange, there is connected to the terminal end portions of the contact members end portions of respective orthogonal terminal members which extend downwardly therefrom in mutually spaced relationship with one another.

The adaptor housing comprises an integral trough-like frame made of resilient dielectric material and having a bottom wall disposed between two longitudinal side walls which extend orthogonally therefrom. The frame has a connector retainer end portion wherein the longitudinal side walls terminate in respective resilient posts which extend upwardly therefrom and have distal end portions provided with respective latching bosses. An adjacent end portion of the bottom wall terminates in an end surface having a central portion from which protrudes longitudinally of the frame a laterally spaced pair of orientation bosses having therebetween a ground contact receiving notch. Disposed in the ground contact receiving notch is an end portion of a spring-like ground contact which extends along a central portion of the bottom wall and is bent at right angles thereto for passing through the thickness of the bottom wall and protruding as a terminal member from the under surface thereof. The frame has an opposing terminal retainer end portion wherein an adjacent end portion of the bottom wall has extended through its thickness an array of mutually spaced, terminal receiving holes. If desired, the array of terminal receiving holes may be disposed between a pair of mutually spaced, latching brackets which extend integrally upward from the bottom wall for retaining therebetween a ferrite slab having extended through its thickness an array of holes which are disposed in registration with respective terminal receiving holes in the bottom wall of the frame.

In assembly, the trough-like frame of the adaptor housing is placed beneath the recumbent cylindrical body of the connector with the orientation notch in the annular flange disposed as the lowermost peripheral portion of the flange. The terminal members extending downwardly from the terminal end portion of the cylindrical body are aligned with respective terminal receiving holes in the bottom wall of the frame. Also, the chordal slots in the external surface of the metallic shell are aligned with respective resilient posts of the frame thereby aligning arcuate edges of the cam portions of the annular flange with respective latching bosses on the resilient posts. A downward pressure on the cylindrical body causes the latching bosses to ride along the arcuate edges of the cam portions and cause distal end portions of the resilient posts to bend laterally away from one another. Downward motion of the cylindrical body stops when the latching bosses on the resilient posts snap radially into respective latching notches in the annular flange. Simultaneously, the resilient posts snap into respective retainer slots in the external surface of the metallic shell to prevent axial movement of the connector relative to the adaptor housing. Also, the metallic shell is brought into electrical engagement with the ground contact; and the terminal members extend through the thickness of the bottom wall of the housing to protrude therefrom in mutually spaced relationship with one another.

BRIEF DESCRIPTION OF THE DRAWINGS

For a better understanding of the disclosed invention, reference is made in the following detailed description to the accompanying drawings wherein.

DESCRIPTION OF THE PREFERRED EMBODIMENTS

Figure 1:
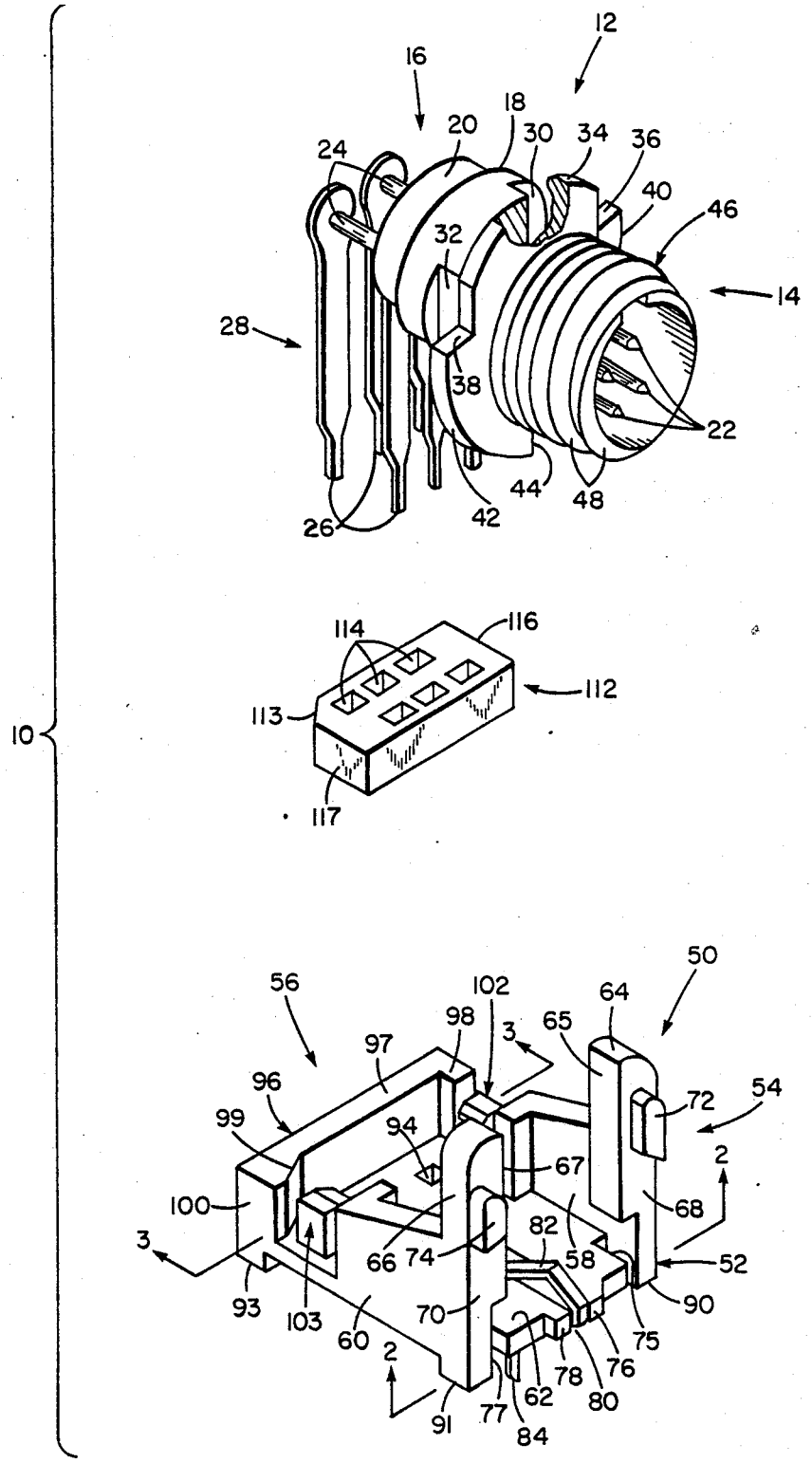
FIG. 1 is an exploded isometric view of a connector adaptor assembly embodying the invention.

Referring to the drawings wherein like characters of reference designate like parts, FIG. 1 shows a connector adaptor assembly 10 comprising an electrical connector 12 having a connector mating end portion 14 and an opposing terminal end portion 16. Connector 12 is provided with a cylindrical body including a metallic tubular shell 18 encircling a plug-like dielectric insert 20 which has axially disposed therein a plurality of mutually spaced contact members 22. The contact members 22 have respective contact engaging end portions extended axially into the connector mating end portion 14 of connector 12. Also, the contact members 22 are connected in a well-known manner, such as integrally for example, to respective terminals 24 which extend in mutual spaced relationship out of an end of dielectric insert 20 in the terminal end portion 16 of connector 12.

The terminals 24 are electrically connected, as by staking, for example, to encircling end portions of respective terminal members 26 which extend orthogonally therefrom in an array 28 of mutually spaced terminal members 26. A first half of the terminals 24 may extend out of the dielectric insert 20 a first uniform axial distance greater than a second uniform axial distance which a second half of the terminals 24 extend out of the dielectric insert 20. Also, the terminal members 26 connected to said first half of the terminals 24 and the terminal members 26 connected to said second half of the terminals 24 may be offset laterally with respect to one another. Thus, the array 28 may be provided with two rows of respective staggered terminal members 26, such as shown by the array of receiving holes 94 in FIG. 2, for example.

Although the connector 12 may be oriented in any direction desired, it will be assumed for purposes of this description that the cylindrical body of connector 12 is disposed in the recumbent position with the terminal members 26 extended vertically in a downward direction from the terminals 24.

Spaced axially along the cylindrical body of connector 12 from the terminal end portion 16 thereof is an external surface portion of metallic shell 18 wherein respective retainer slots 30 and 32 are disposed chordally in spaced opposing relationship with one another. The retainer slots 30 and 32 are disposed orthogonally with respect to the axial centerline of connector 12 and, in this instance, extend vertically in a direction similar to that of the array 28 of terminal members 26. Each of the retainer slots 30 and 32 has a side wall formed of respective contiguous surface portions of an annular flange 34 which extends integrally outward in the radial direction from the external surface of metallic shell 18.

Adjacent upper end portions of the slots 30 and 32 there is extended from the outer edge of flange 34 into respective marginal portions thereof latching notches 36 and 38, respectively, which are radially spaced from the slots 30 and 32, respectively. Each of the latching notches 36 and 38 has a vertical side wall integrally joined at an obtuse angle to a respective sloped side wall of the notch. The vertical side walls of latching notches 36 and 38 are disposed substantially parallel with the respective adjacent slots 30 and 32 and are laterally spaced apart. The sloped side walls of latching notches 36 and 38 extend downwardly from the lower end portions of the respective vertical side walls of latching notches 36 and 38 to terminate in opposing edge portions of the flange 34 which are spaced chordally apart a distance less than the transverse diameter of flange 34. The latching notches 36 and 38 are spaced by interposed arcuate cam portions 40 and 42, respectively, of the flange 34 from a generally U-shaped, orientation notch 44 disposed in the lowermost peripheral portion of flange 34. Thus, the orientation notch 44 is disposed in the lower semi-circular half of flange 34 below the transverse diameter thereof; and the latching notches 36 and 38 are disposed in the upper semi-circular half of flange 34 above the transverse diameter thereof.

The flange 34 is integrally joined to a proximal end portion of an axially extending coupler bushing 46 having an opposing end which terminates the metallic shell 18 of connector 12. Bushing 46 insulatingly encircles the contact engaging end portions of the contact members 22 extending into the connector mating end portion of connector 12. The bushing 46 is provided with means, such as external threads 48, for example, for securing the connector 12 to a mating electrical connector (not shown) whereby the adjacent end portions of contact members 22 are held in electrical engagement with respective contact members (not shown) of the mating electrical connector.

Accordingly, the connector 12 is oriented for installation in an underlying adaptor housing 50 comprising a trough-like frame 52 made of resilient dielectric material, such as glass filled polyester material, for example. Housing 50 has a connector retainer end portion 54 and an opposing terminal retainer end portion 56 disposed beneath the connector mating end portion 14 and the terminal end portion 16, respectively, of connector 12. The trough-like frame 52 includes a longitudinally extending pair of spaced opposing side walls, 58 and 60, respectively, which are integrally connected to one another through an interposed bottom wall 62 of frame 52.

In the connector retainer end portion 54 of housing 50, the longitudinal side walls 58 and 60 are integrally joined to adjacent surfaces of respective upwardly extending, retainer posts 64 and 66 which have respective orthogonal surfaces 65 and 67 opposing one another. The surfaces 65 and 67 terminate respective inwardly projecting portions of the posts 64 and 66 which extend integrally from the inner surfaces of side walls 58 and 60 toward one another. Posts 64 and 66 have orthogonal to the surfaces 65 and 67 respective surfaces 68 and 70 including upper end portions thereof from which extend integral mesa-like latching bosses, 72 and 74, respectively. The latching bosses 72 and 74 have respective lower sides which are sloped downwardly, at respective rake angles, from their ends adjacent one another to their opposing ends. Thus, the lower sides of latching bosses 72 and 74 are provided with respective angular inclinations suitable for making them substantially complementary to the ramp-like lower sides of latching notches 36 and 38, respectively.

The bottom wall 62 of trough-like frame 52 has disposed in portions thereof adjacent retainer posts 64 and 66 respective open-ended slots 75 and 77 which enhance the flexibility of retainer posts 64 and 66, respectively. Also, adjacent the surfaces 68 and 70 of retainer posts 64 and 66, respectively, the bottom wall 62 of trough-like frame 52 terminates in an end surface having protruding integrally from a central portion thereof a pair of laterally spaced orientation stubs, 76 and 78, respectively. The orientation stubs 76 and 78 define an interposed slot 80 wherein an end portion of a leaf spring ground contact 82 is disposed. Ground contact 82 has an upwardly arched portion extending longitudinally along a central portion of bottom wall 62. Furthermore, the ground contact 82 has a right-angled bent portion passed through the thickness of bottom wall 62 to protrude from the lower surface thereof as ground terminal 84.

Figure 2:
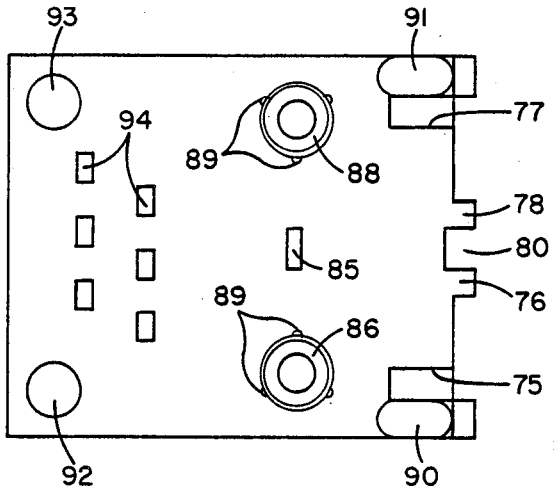
FIG. 2 is a plan bottom view of the adaptor housing taken along the line 2—2 shown in FIG. 1 and looking in the direction of the arrows.

As shown more clearly in FIG. 2, the ground terminal 84 may extend from a through-hole 85 provided, as by molding, for example, in the bottom wall 62. The hole 85 is disposed centrally in spaced relationship between two aligned locating posts, 86 and 88, respectively, which extend integrally from the lower surface of bottom wall 62. Each of the locating posts 86 and 88 has an outer periphery including a plurality of angularly spaced, locking ridges 89 which extend linearly along the lengths of locating posts 86 and 88. Two corner portions of the lower surface of the bottom wall 62 adjacent the posts 86 and 88 may have protruding integrally therefrom respective legs 90 and 91 which are disposed for supporting the housing 50.

In the terminal retainer end portion 56 of housing 50, the lower surface of bottom wall 62 has two transversely spaced corner portions from which respective legs 92 and 93 integrally protrude to respective lengths substantially equal to the lengths of legs 90 and 91. A transverse portion of bottom wall 62 adjacent the legs 92 and 93 has extended through its thickness two rows of mutually spaced holes 94 which are staggered in correspondence to the arrangement of terminal members 26. Thus, the terminal members 26 are aligned with respective holes 94 in the bottom wall 62 for extending therethrough to protrude from the lower surface of bottom wall 62 similar to the ground terminal 84. Accordingly, the array of holes 94 in bottom wall 62 comprises a means for retaining the terminal members 26 in predetermined spaced relationship with one another and with the locating posts 86 and 88, respectively.

Referring again to FIG. 1, the terminal end portion 56 of housing 50 may terminate in a transverse portion 97 of an upright end wall 96 which extends integrally from the upper surface of bottom wall 62. Transverse portion 97 has an end portion forming a right-angle with an integrally joined longitudinal portion 98 of end wall 96. The longitudinal portion 98 is spaced from an adjacent right-angled end portion of longitudinal side wall 58 to provide an interposed opening wherein a resilient latching bracket 102 extends integrally upward from the upper surface of bottom wall 62. Also, the transverse portion 97 has an opposing end portion integrally joined to an orthogonal longitudinal portion 100 of end wall 96 through a bevelled corner portion 99 thereof which serves as an orientation means in a manner to be described. The longitudinal portion 100 is spaced from an adjacent right-angled end portion of longitudinal side wall 60 to provide an interposed opening wherein a resilient latching bracket 103 extends integrally upward from the upper surface of bottom wall 62. Thus, the transverse portion 97 of end wall 96 and the right-angled end portions of respective longitudinal side walls 58 and 60 define an interposed width dimension of a generally rectangular area of bottom wall 62 wherein the array of holes 94 is disposed.

Figure 3:
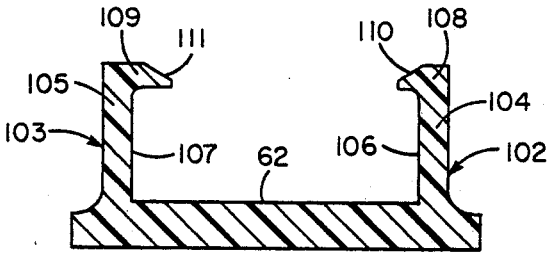
FIG. 3 is a cross-sectional view taken along the line 3—3 shown in FIG. 1 and looking in the direction of the arrows. adaptor assembly embodying the invention.

As shown more clearly in FIG. 3, the latching brackets 102 and 103 include respective support members 104 and 105 having proximal end portions integrally attached to the bottom wall 62 and having respective opposing surfaces 106 and 107 spaced a predetermined distance apart. Accordingly, the opposing surfaces 106 and 107 of respective support members 104 and 105 define an interposed length dimension of the generally rectangular area of bottom wall 62 wherein the array of holes 94 is disposed. The support members 104 and 105 have distal end portions integrally joined to respective orthogonally projecting lip members 108 and 109 which extend toward one another at a predetermined distance from the upper surface of bottom wall 62. The lip members 108 and 109 terminate in respective tapered end portions 110 and 111 which are disposed in opposing relationship with one another and are spaced apart a distance less than the predetermined distance between the respective opposing surfaces 106 and 107 of the support members 104 and 105.

As shown in FIG. 1, the adaptor housing 50 may be provided with an electrical noise suppressing means comprising a generally rectangular slab 112 of ferromagnetic material, such as ferrite material, for example. The slab 112 has extended through its thickness an array of two rows of mutually spaced holes 114 which are staggered in correspondence to the arrangement of holes 94. Also, the slab 112 has a bevelled corner portion 113 which complements the bevelled corner portion 99 of end wall 96 and is aligned with it for orienting the array of holes 114 with the array of holes 94. Moreover, the slab 112 has opposing longitudinal sides which define a width dimension substantially equal to the width dimension defined by the transverse portion 97 of end wall 96 and the right-angled end portions of longitudinal sides walls 58 and 60, respectively. Furthermore, the slab 112 has opposing ends, 116 and 117, respectively, which define a length dimension greater than the distance between tapered end portions 110 and 111 of projecting lip members 108 and 109, respectively, and substantially equal to the distance between the opposing surfaces 106 and 107 of respective support members 104 and 105 (FIG. 3). Thus, the slab 112 is provided with a suitable size for occupying substantially all of the generally rectangular area of bottom wall 62 defined by the end wall 96, the latching brackets 102 and 103, respectively, and the right-angled end portions of longitudinal side walls 58 and 60, respectively.

When an electrical noise suppressing means is required, the slab 112 may be assembled as a component part of the adaptor housing 50 prior to the assembly of connector 12. The slab 112 is placed lengthwise on the projecting lip members 108 and 109 such that the ends 116 and 117 of slab 112 are disposed adjacent the tapered end portions 110 and 111, respectively. Slab 112 is then pressed toward the bottom wall 62 whereby the ends 116 and 117 of slab 112 slide downwardly along the respective sloped surfaces of the tapered end portions 110 and 111. As a result, the support members 104 and 105 bend pivotally away from one another to allow the length of slab 112 to pass between the tapered end portions 110 and 111 of the resilient latching brackets 102 and 103, respectively. Consequently, when the slab 112 is pressed against the aligned area of bottom wall 62, the latching brackets 102–103 return to their relaxed states and the projecting lip members 108–109 overlap respective end portions 116–117 of the slab 112 to lock it in position. Thus, the bevelled corner portion 113 of slab 112 is disposed in contiguous relationship with the bevelled corner portion 99 of end wall 96; and the holes 114 in slab 112 are disposed in registration with respective holes 94 in the bottom wall 62 of frame 52.

Accordingly, when the connector 12 is installed in adaptor housing 50, the terminal members 26 may be inserted through respective aligned holes 114 and 94 to protrude from the far surface of bottom wall 62, as described. As a result, each of the terminal members 26 will be encircled by the ferromagnetic material of slab 112 for attenuating high frequency electrical noise and spurious signals in a well-known manner. However, it is to be understood that in situations where high frequency signal suppression is not required, the slab 112 may be eliminated and the terminal members 26 inserted directly through respective aligned holes 94 in bottom wall 62. Moreover, the adaptor housing 50 need not be provided with the end wall 96 and the latching brackets 102 and 103, respectively. Alternatively, the respective longitudinal side walls 58 and 60 may extend uninterruptedly from the respective posts 64 and 66 to the terminal retainer end of housing 50.

In assembling the connector 12 into adaptor housing 50, the cam edge portions 40 and 42 of flange 34 are placed on upper end portions of the latching bosses 72 and 74, respectively; and the orientation notch 44 is disposed centrally therebetween. Flange 34 is pressed against the outer surfaces 68 and 70 of retainer posts 64 and 66, respectively; and the respective inwardly projected surfaces 65 and 67 of retainer posts 64 and 66 are disposed in the chordal slots 30 and 32, respectively, in metallic shell 18. The terminal members 26 are aligned with respective holes 94 in bottom wall 62 or with respective holes 114 in slab 112, if present; and the cylindrical body of connector 12 is pressed toward the bottom wall 62 of frame 52. As a result, the portion of flange 34 including orientation notch 44 disposed between the cam edge portions 40 and 42 is forced between adjacent surfaces of the latching bosses 72 and 74, respectively; and the latching bosses 72 and 74 slide along the cam edge portions 40 and 42, respectively.

Consequently, the upper end portions of resilient retainer posts 64 and 66 are bent laterally away from one another thereby removing their respective surfaces 65 and 67 from the chordal slots 30 and 32, respectively, in metallic shell 18. Simultaneously, the lower end portions of retainer posts 64 and 66 are bent laterally toward one another thereby decreasing slightly the widths of the open-ended slots 75 and 77, respectively, in the bottom wall 62. Thus, the attached side walls 58 and 60 are distorted accordingly thereby storing in the resilient materials of the side walls 58 and 60 respective tortuous resilient forces which tend to restore the resilient posts 65 and 66 to their respective relaxed positions. Therefore, after the lower semi-circular half of flange 34 has passed between the latching bosses 72 and 74, the upper end portions of resilient retainer posts 64 and 66 commence moving laterally back toward one another while the lower end portions thereof commence moving laterally away from one another toward their respective relaxed positions.

Figure 4:
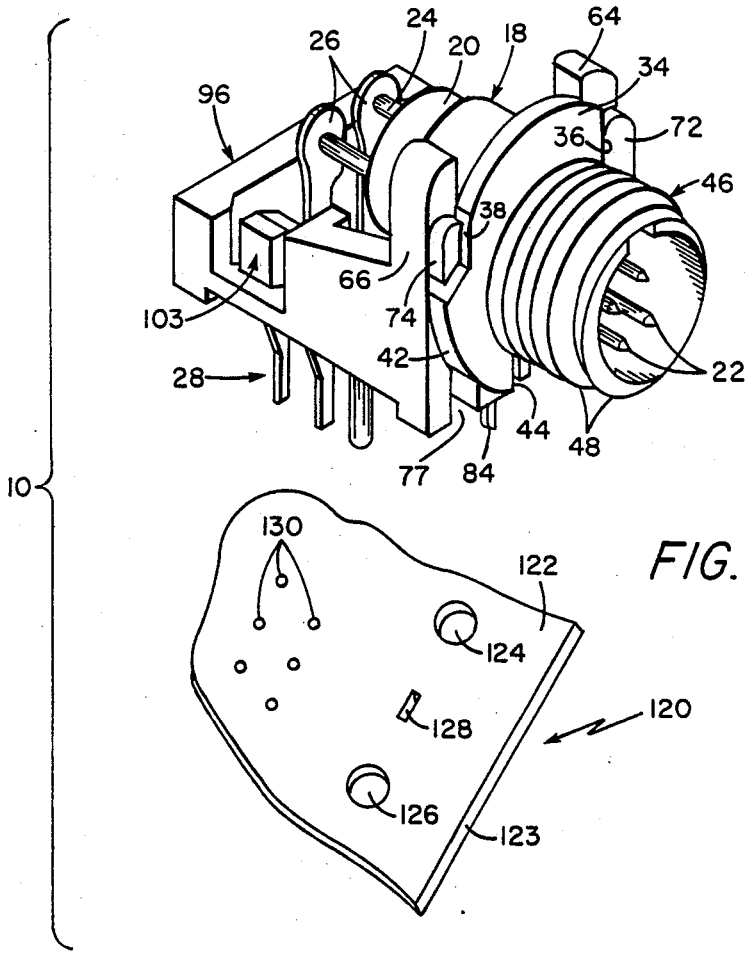
FIG. 4 is an assembled isometric view of the connector adaptor assembly shown in FIG. 1 prior to mounting on a printed circuit board.
Figure 5:
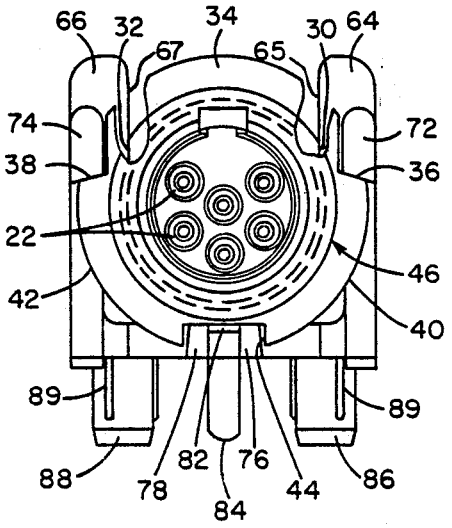
FIG. 5 is a front elevational view of the assembly shown in FIG. 4.

As shown in FIGS. 4 and 5, when the sloped lower surfaces of latching bosses 72 and 74 are disposed for sliding up the similarly sloped lower walls of latching notches 36 and 38, respectively, the resilient retainer posts 64 and 66 snap back to their respective relaxed states. As a result, the opposing vertical side surfaces of latching bosses 72 and 74 are disposed adjacent the vertical side walls of latching notches 36 and 38, respectively, thereby locking the connector 12 into the adaptor housing 50. Simultaneously, the inwardly projected portions of resilient retainer posts 64 and 66 terminating in the respective surfaces 65 and 69 snap back into the chordal slots 30 and 32, respectively, thereby preventing axial movement of the connector 12 relative to the trough-like frame 52 of housing 50. Also, the orientation stubs 76 and 78 are disposed in the orientation notch 44 to orient the connector 12 rotationally relative to the frame 52. Moreover, the metallic shell 18 of connector 12 is disposed in electrically contacting relationship with the upwardly arched portion of ground contact 82 whereby the metallic shell 18 of connector 12 is connected electrically to ground terminal 84 protruding from the lower surface of bottom wall 62. Furthermore, the array 28 of terminal members 26 extends through respective holes 94 in bottom wall 62 to protrude from the lower surface thereof a distance which is independent of the presence or absence of slab 112. Preferably, the terminal members 26 protrude from the lower surface of bottom wall 62 respective uniform distances which are substantially equal to the protruding length of ground terminal 84 and are considerably less than the protruding lengths of locating posts 86 and 88, respectively.

Accordingly, the connector 12 is assembled into the adaptor housing 50 to form the connector adaptor assembly 10 for mounting the connector 12 in a recumbent position on an edge portion of an underlying printed circuit board 120. The printed circuit board 120 comprises a generally planar substrate 122 of dielectric material having a linear edge 123 adjacent which a pair of laterally spaced, locating holes, 124 and 126, respectively, extend through the thickness of substrate 122. A portion of substrate 122 disposed centrally between the respective locating holes 124 and 126 has extended through its thickness a plated through-hole 128. Spaced from the respective locating holes 124 and 126 are two rows of plated through-holes 130 which are mutually spaced apart and staggered similar to the arrangements of holes 94 in wall 62 and the terminal members 26 of array 28. The plated through-holes 130 and the through-hole 128 may be connected electrically to respective conductors (not shown) plated on the opposing broad surface of substrate 122.

The connector adaptor assembly 10 is installed on the printed circuit board 120 by forcefully inserting the distal end portions of locating posts 86 and 88 into the respective locating holes 124 and 126 of substrate 122. The longitudinal extending series of angularly spaced ridges 89 on the outer surfaces of locating posts 86 and 88 provide means for effecting a tight fit between the locating posts 86 and 88 and the peripheries of suitably sized holes 124 and 126, respectively. The terminal members 26 are aligned with respective through-holes 130; and the connector adaptor assembly 10 is pressed forcefully toward the pointed circuit board 120. As a result, the terminal members 26 are pressed into respective aligned holes 130 and the ground terminal 84 is pressed into the aligned hole 128, until the respective legs 90–93 are seated on the substrate 122. Thus, the cylindrical connector 12 is mounted in a recumbent position on the planar substrate 122 such that the axial centerline of connector 12 is substantially parallel with the plane of substrate 122. Also, the coupler bushing 46 terminating the mating end portion 54 of connector 12 is extended over the linear edge 123 of substrate 122 for electrical connection to a mating connector (not shown). Consequently, after mounting the connector adaptor assembly 10 on the printed circuit board 120, as described, the resulting sub-assembly may be subjected to a suitable operation, such as wave-soldering, for example, for electrically connecting the terminal members 26 to the peripheries of respective plated through-holes 130 and the ground terminal 84 to the periphery of plated through-hole 128.

Thus, there has been disclosed herein a connector adaptor assembly 10 including a cylindrical connector 12 secured, without requiring tools or auxiliary fastener devices, in a recumbent position in a trough-like frame 52 of an adaptor housing 50. Also, prior to installing the connector 12 in frame 52, the adaptor housing 50 may have secured therein, without requiring tools or auxiliary fastener devices, an electrical noise suppressing means comprising a slab 112 of ferromagnetic material. Moreover, after installing the connector 12 in the trough-like frame 52 of adaptor housing 50, the resulting assembly may be mounted, without the need of tools or auxiliary fastener devices, on dielectric substrate 122 of printed circuit board 120 such that the axial centerline of connector 12 is disposed substantially parallel to the plane of the substrate 122.

From the foregoing, it will be apparent that all of the objectives have been achieved by the structures and methods described herein. It also will be apparent, however, that various changes may be made by those skilled in the art without departing from the spirit of the inventive subject matter, as as expressed in the appended claims. It is to be understood, therefore, that all matter shown and described is to be interpreted as illustrative and not in a limiting sense.

What is claimed is:

1. A connector adaptor housing comprising:

a trough-like frame made of resilient dielectric material and having a bottom wall with opposing longitudinal edge portions integrally joined to respective first and second orthogonal side wall means for receiving therebetween a recumbent cylindrical connector;

connector retainer means disposed integrally in said frame for retaining said connector in predetermined positional relationship to said frame independently of extraneous fastener devices;

said connector retainer means including first and second resilient posts terminating said first and second wall means, respectively, adjacent one end of said bottom wall and having respective first and second distal end portion means extended beyond said first and second side wall means for resiliently engaging respective adjacent portions of said recumbent cylindrical connector and preventing axial movement thereof relative to said frame;

said connector retainer means further including an opposing end portion of said bottom wall having extended through its thickness an array of mutually spaced aperture means for receiving respective terminal members extended from said connector and for retaining said terminal members in predetermined positional relationship relative to said frame; and said connector retainer means further including a slab of ferromagnetic material latchingly secured over said array of mutually spaced aperture means and having extended through its thickness a similar array of mutually spaced holes, each of said holes being disposed in registration with a respective one of said aperture means.

2. A connector adaptor assembly comprising;

an adaptor housing including a trough-like frame made of resilient dielectric material and having a bottom wall extended integrally between first and second side walls of said frame provided with respective opposing inner surfaces, said bottom wall having an end surface in an end portion of said frame provided with integral latching means for retaining a body inserted into said housing in predetermined positional relationship with said frame;

an electrical connector including a cylindrical body disposed recumbently between said first and second side walls of said frame and having a transverse portion disposed adjacent said end surface of said bottom wall, said transverse portion being provided with latch engaging means for cooperating with said latching means in retaining said cylindrical body of said connector in predetermined positional relationship with said frame;

said latching means including first and second resilient posts integrally joined to end portions of said first and second side walls, respectively, in said end portion of said frame and having respective first and second distal end portions extended beyond said first and second side walls, respectively, said first and second distal end portions having adjacent said end surface of said bottom wall respective surfaces from which protrude integrally respective first and second latching bosses, said first and second latching bosses having therebetween a predetermined distance of lateral spacing;

said latch engaging means further including an annular flange extended radially outward from said cylindrical body of said connector and having a surface disposed against said respective surfaces of said first and second distal end portions, said flange having a diameter greater than said predetermined distance of lateral spacing and having adjacent said first and second latching bosses respective peripheral portions comprising first and second cam means for pressing laterally against said first and second bosses, respectively, bending said first and second distal end portions of said first and second resilient posts laterally away from one another, and allowing said diameter of said flange to pass therebetween;

said latch engaging means further including first and second notched portions of said flange disposed adjacent said first and second peripheral portions of said flange and comprising respective first and second recess means for receiving therein said first and second latching bosses, respectively, allowing said first and second distal end portions of said first and second resilient posts to return their relaxed states, and securing said cylindrical body into said frame;

said latching means including said end surface of said bottom wall having protruding integrally therefrom a projection stub; and said latch engaging means including a third notched portion of said flange disposed adjacent said bottom wall and comprising third recess means for receiving therein said projection stub and orienting said cylindrical body of said connector rotationally relative to said frame.

3. A connector adaptor assembly as set forth in claim 2 wherein said latching means includes first and second inwardly projecting portions of said first and second resilient posts, respectively, extended toward one another from said opposing inner surfaces of said first and second side walls; and said latch engaging means includes first and second slot means disposed chordally in respective opposing surface portions of said cylindrical body for receiving therein said first and second inwardly projecting portions, respectively, of said first and second resilient posts and retaining said cylindrical body of said connector axially relative to said frame.

4. A connector adaptor assembly comprising:

an electrical connector having a mating end portion and a rearwardly extending cylindrical body encasing a plurality of longitudinally disposed electrical contacts that connect to respective orthogonal terminals, said body having diametrically opposed vertically extending side slots, said body further having an annular flange with opposing notches positioned adjacent said slots; and a dielectric frame adapted for receiving said electrical connector in snap locking engagement and mounting said electrical connector to a circuit board, said dielectric frame having a bottom with a plurality of apertures arranged for receiving respective ones of said orthogonal terminals of said electrical connector, said frame having a pair of upwardly extending retainer posts spaced so as to be received in said respective slots of said connector body in sliding engagement as said electrical connector is lowered downwardly onto said frame, said retainer posts having latching bosses that engage and slide against the outer perimeter edge of said flange of said electrical connector as said connector is being engaged to said frame wherein said retainer posts are resiliently pushed outwardly until said latching bosses align with said notches of said flange at which time said posts snap inwardly with said bosses seating in said notches in locking engagement, said retainer posts being seated in said slots so as to prevent axial movement of said electrical connector with respect to said frame.

5. The assembly recited in claim 4 wherein said bottom of said frame has a forwardly projecting stub and said flange of said connector has a bottom notch that aligns with and engages said stub for preventing said electrical connector from rotating within said frame.

6. The assembly recited in claim 4 further comprising a ferrite wafer mounted between said bottom of said frame and said electrical connector, said wafer having corresponding apertures through which said orthogonal terminals of said electrical connector extend.

* * * * *